United States Patent [19]

Lengemann et al.

[11] 4,257,875

[45] Mar. 24, 1981

[54] FLUID CATALYTIC CRACKING PROCESS

[75] Inventors: Robert A. Lengemann, Arlington Heights; Gregory J. Thompson, Waukegan; Anthony G. Vickers, Arlington Heights, all of Ill.

[73] Assignee: UOP Inc., Des Plaines, Ill.

[21] Appl. No.: 43,527

[22] Filed: May 29, 1979

[51] Int. Cl.[3] ..... C10G 11/18; C10G 51/00

[52] U.S. Cl. ..... 208/113; 208/74; 208/75; 208/120; 208/153

[58] Field of Search ..... 208/113, 120, 9, 153, 208/74–75

[56] References Cited

U.S. PATENT DOCUMENTS

| | | | |
|---|---|---|---|
| 2,451,619 | 10/1948 | Hengstebeck et al. | 208/150 |
| 3,186,805 | 6/1965 | Gomory | 208/74 X |
| 3,380,911 | 4/1968 | Owen | 208/74 |
| 3,639,228 | 2/1972 | Carr et al. | 208/153 |
| 3,856,659 | 12/1974 | Owen | 208/80 |
| 3,926,778 | 12/1975 | Owen et al. | 208/74 |
| 4,090,948 | 5/1978 | Schwartzenbek | 208/74 |
| 4,116,814 | 9/1978 | Zahner | 208/78 |
| 4,162,213 | 7/1979 | Zrinscak et al. | 208/89 |

*Primary Examiner*—Delbert E. Gantz
*Assistant Examiner*—G. E. Schmitkons
*Attorney, Agent, or Firm*—James R. Hoatson, Jr.; John G. Cutts, Jr.; William H. Page II

[57] ABSTRACT

An improved fluid catalytic cracking process providing improved product yield and selectivity and reduced catalyst deactivation which employs a split flow of catalyst to the reactor riser.

1 Claim, No Drawings

FLUID CATALYTIC CRACKING PROCESS

BACKGROUND OF THE INVENTION

Catalytic cracking of heavy petroleum fractions is one of the major refining operations employed in the conversion of crude petroleum oils to desirable fuel products such as high-octane gasoline fuels used in spark-ignited internal combustion engines. Illustrative of "fluid" catalytic conversion processes is the fluid catalytic cracking process wherein suitably preheated high molecular weight hydrocarbon liquids and vapors are contacted with hot, finely-divided, solid catalyst particles, either in a fluidized bed reactor or in an elongated riser reactor, and maintained at an elevated temperature in a fluidized or dispersed state for a period of time sufficient to effect the desired degree of cracking to lower molecular weight hydrocarbons typically present in motor gasolines and distillate fuels. Suitable hydrocarbon feeds boil generally within the range from about 400° to about 1200° F. and are usually cracked at temperatures ranging from 850° to 1100° F.

In a catalytic process some non-volatile carbonaceous material, or "coke", is deposited on the catalyst particles. Coke comprises highly condensed aromatic hydrocarbons which generally contain 4–10 wt. % hydrogen. As coke builds up on the catalyst, the activity of the catalyst for cracking and the selectivity of the catalyst for producing gasoline blending stock diminish. The catalyst particles may recover a major proportion of their original capabilities by removal of most of the coke therefrom by a suitable regeneration process.

Catalyst regeneration is accomplished by burning the coke deposits from the catalyst surface with an oxygen-containing gas, such as air. Many regeneration techniques are practiced commercially whereby a significant restoration of catalyst activity is achieved in response to the degree of coke removal.

The regenerated catalyst is recycled to contact fresh hydrocarbon feedstock and to convert hydrocarbon to more valuable products.

SUMMARY OF THE INVENTION

This invention relates to an improved fluid catalytic cracking process for the introduction of circulating catalyst into the hydrocarbon feedstock. It has been found that in fluid catalytic cracking processes there are advantages to having the regenerated, recycle catalyst returned to the riser at more than one locus. Furthermore, it is even more preferred if the first stream of regenerated, recycled catalyst which is first contacted with the feedstock is introduced in a quantity sufficient to raise the feed temperature into the reactive range, that is above 850° F. and preferably above 950° F., and thereby vaporize most of the distillable portion of the feed.

DETAILED DESCRIPTION

In the processing of hydrocarbons in a fluid catalytic cracking process, the increasing cost and shortage of supply of crude oil is causing the necessity to process unconventional sources of hydrocarbons such as, for example, reduced crude, coal derived oil, oil shale, and tar sand derived oil. This dilemma requires that the conventional fluid catalytic cracking processes be modified to satisfactorily utilize these feedstocks. One method which may be a desirable modification of the conventional fluid catalytic cracking process is to have multiple regenerated catalyst inlets to the reactor riser. We have discovered that a superior fluid catalytic cracking process is obtained if the first stream of regenerated catalyst to the riser has a flow rate sufficient to raise the temperature into the reactive range, that is above the 850° F. and preferably above 950° F., and thereby vaporize most of the vaporizable portion of the feedstock.

The preferred embodiment of the invention is illustrated in the example hereinafter described. The following initial description of the invention will be set only in terms of the preferred embodiment. Other embodiments of the invention, which include feedstocks, catalyst flow systems, and catalysts will then be described. Although the general description will only refer to two regenerated, recycle catalyst lines to the reactor riser, the invention may be applied to a process having three or more catalyst supply lines.

Accordingly, a broad embodiment of the present invention may be characterized as a method for contacting a hydrocarbon containing feedstock in a fluid catalytic process with at least two streams of regenerated, recycled catalyst wherein a first portion of the recycled catalyst vaporizes the majority of the fresh feedstock. In a more particular embodiment of the invention is a process for catalytically cracking hydrocarbonaceous feedstocks having a Conradson Carbon Number greater than about 1 wherein fluidizable cracking catalyst, contaminated with metals to a level of vanadium and nickel of greater than about 1000 ppm, and which catalyst has been deactivated with coke deposits is withdrawn from the cracking reaction zone, stripped of volatile material, passed to a regeneration zone, and recycled after regeneration to the reaction zone, the method comprising: (a) contacting said feedstock with at least a portion of said recycled, regenerated catalyst which catalyst has a flow rate sufficient to raise the temperature into the reactive range, that is above 850° F. and preferably above 950° F., and thereby vaporize most of the vaporizable portion of said feedstock; and (b) contacting said feedstock combined with said first portion of recycled, regenerated catalyst with a second portion of recycled, regenerated catalyst.

Although the type of catalyst is not an essential portion of this invention, catalyst is required and a suitable catalyst can be any commercially available cracking catalyst. Preferably, catalysts are zeolitic. Zeolitic or molecular sieve catalysts for converting hydrocarbons to gasoline fractions are well known in the art and are commercially available. Non-zeolite catalysts may also be used.

The catalysts generally have a particle size of about 5 to about 150 microns and preferably predominantly about 40 to about 80 microns. A process designed to utilize a reduced crude or similar hydrocarbon can benefit most significantly from the present invention.

Such hydrocarbon containing feedstocks contain heavy metals including nickel and vanadium in quantities usually greater than about 2–3 ppm. and heptane-insolubles in quantities usually greater than about 0.1 weight percent. Another characteristic of reduced crude which is also often referred to as black oil is the Conradson Carbon level which is expressed as a weight percent of the reduced crude fraction. Typical reduced crude oils and the like generally have a Conradson Carbon level of about one weight percent or greater. The procedure for determining the Conradson Carbon level provides a weight percent number which reflects the total residue including carbon resulting from the high temperature pyrolysis of the hydrocarbon sample. These contaminants have heretofore precluded the facile utilization of contaminated feedstocks in fluid catalytic cracking processes by depositing excessive amounts of coke and metals upon the catalyst. The excess coke must be removed from the catalyst during regeneration in order to yield an active recycle catalyst for introduction into the reactor riser. The metals are essentially permanently deposited on the catalyst and are not removed by conventional catalyst regeneration or oxidation. Gradual build-up of the metals on the catalyst permits the promotion of undesirable side reactions which lower the yield and quality of the desired product.

The method of the present invention obviates or at least tends to minimize the undesirable side reactions hereabove described. Under normal circumstances, the coke on the catalyst will occupy active sites and the catalyst activity will be reduced. But with the case of two or more regenerated catalyst introduction locations and with a majority of the feedstock vaporized before reaching the location of additional catalyst introduction locations, freshly regenerated and active catalyst is allowed to contact an essentially vaporized hydrocarbon feedstock and to selectively produce the desired quality products.

The preferred feedstocks utilized with the present invention more than likely contain non-distillable hydrocarbons which are generally thought to be coke precursors under relatively high temperature conditions such as those encountered in catalytic cracking. Since these non-distillables by their very nature will not vaporize and will probably immediately agglomerate on the first hot, regenerated catalyst particles which they encounter, somewhat less than 100 volume percent of the feedstock will vaporize and require the transmittal of the necessary heat of vaporization provided by hot, regenerated catalyst. If the temperature is raised into the reactive region, the light hydrocarbons produced will also assist in volatizing the heavier components. It is also foreseen that diluent streams, such as steam or light hydrocarbon gases, could also be introduced with the bottom of the riser in order to maximize the degree of vaporization of the feed. Therefore, according to the present invention, the flow of hot, regenerated catalyst to the first catalyst inlet is determined by the selected temperature, preferably above 950° F., and by the amount of vaporizable hydrocarbons present in any one given feedstock. Once that essentially all of the vaporizable hydrocarbons have been vaporized, the feedstock is then contacted with a second stream of hot, regenerated catalyst.

Suitable hydrocarbon feedstocks include light gas oils, heavy gas oils, vacuum gas oils, kerosenes, deasphalted oils and residual fractions, as well as suitable fractions derived from shale oil, tar sands, synthetic oils and the like. Such fractions may be employed singly or in any desired combination.

The following example is presented in illustration of the preferred embodiment and is not intended as an undue limitation on the generally broad scope of the invention as set out in the appended claims.

EXAMPLE

Simulated tests were made to illustrate the advantage of this invention. The tests were based upon cracking a light Arabian reduced crude having an initial boiling point of 680° F., a gravity of 17.9° API, 2.9 weight percent sulfur, 6.4 ppm nickel, 21.3 ppm vanadium and a Conradson Carbon of 7 weight percent. The tests were conducted in an upflow riser with a zeolite fluid cracking catalyst. The operating conditions of all tests include a raw-oil temperature of 500° F., a catalyst regenerator temperature of 1355° F., a reactor pressure of 20 psig., a total catalyst to oil ratio of 8.95 pound-/pound and a reactor outlet temperature of 1030° F.

The tests differ only in the manner of admission of catalyst to the riser. In the base test, the total amount of catalyst is admitted to the bottom of the riser together with the total hydrocarbon feed stream. In the simulated comparative test which is illustrative of the present invention, 61.7 percent of the total catalyst charge is introduced to the bottom of the riser together with the total hydrocarbon feed stream while the remaining 38.3 percent is charged to the riser at a subsequent catalyst inlet in order to be admixed with the stream which comprises the feed stream which has been previously admixed with the hereinabove mentioned 61.7 percent of the total catalyst. In the comparative test, it is estimated that 61.7 percent of the total catalyst is required, in order to reach the desired temperature of about 1000° F. in the lower vaporizing zone of the riser.

In the base case, the conversion was 76.8 volume percent as compared to 79.0 volume percent in the comparative case. Further details of the results from both of these tests are presented in Table I. From a comparison of the product distribution and conversion for each of the tests, the enhanced product yields of the comparative test are apparent.

TABLE I

TEST SUMMARY

| | Conventional | 2-Inlet |
|---|---|---|
| perating Conditions | | |
| Configuration | | |
| Raw oil temperature, °F. | 500 | 500 |
| Reactor outlet temperature, °F. | 1030 | 1030 |
| Regenerator temperature, °F. | 1355 | 1355 |
| Catalyst oil ratio, lb/lb | 8.95 | 8.95 |
| % of catalyst to first inlet | 100 | 61.7 |
| % of catalyst to second inlet | — | 38.3 |
| Conversion, volume % | 76.8 | 79.0 |
| Product Distribution | | |
| $H_2S$, plus $C_2^-$, wt. % | 6.57 | 6.50 |
| $C_3$'s, wt. % | 7.28 | 7.30 |
| $C_4$'s, wt. % | 9.00 | 9.60 |
| $C_5$-380 @ 90% gasoline, vol. % | 50.60 | 52.70 |
| Light cycle oil, vol. % | 11.80 | 10.50 |
| Clarified oil, vol. % | 11.40 | 10.50 |
| Coke, wt. % | 10.40 | 10.40 |
| Feedstock | | |
| Light Arabian 680° F. reduced crude | | |
| Gravity, °API | 17.9 | |
| Sulfur, wt. % | 2.92 | |
| Conradson carbon, wt. % | 7.0 | |
| Nickel, ppm | 6.4 | |
| Vanadium, ppm | 21.3 | |

The foregoing description and example demonstrate the method by which the present invention is effected and the benefits afforded through the utilization thereof.

We claim as our invention:

1. In a process for catalytically cracking in a reaction zone a hydrocarbonaceous feedstock having a distillate portion and a Conradson Carbon Number greater than about 1 and a vanadium and nickel heavy metal content of greater than about 2 ppm in the presence of a fluidizable cracking catalyst containing a heavy metal level comprising vanadium and nickel of greater than about 1000 ppm and which fluidizable cracking catalyst is deactivated by the deposition of coke deposits during said cracking, passed to a regeneration zone for reactivation of said fluidizable cracking catalyst by removal of said coke deposition and recycled after said reactivation to said reaction zone as the only catalyst to contact said feedstock, the improvement which comprises:

(a) passing a first portion of said reactivated catalyst in contact with said feedstock at a flow rate sufficient to raise the temperature of said feedstock to a temperature of 850°–1050° F. and thereby vaporize a part of the distillate portion of said feedstock; and (b) passing a second portion of said reactivated catalyst to said reaction zone at a point distinct from said addition of step (a) to contact said first portion of said reactivated catalyst and feedstock containing said vaporized part of the distillate portion of said feedstock to effect the cracking of said feedstock.

* * * * *